US009616554B2

(12) United States Patent
Hendrix, II

(10) Patent No.: US 9,616,554 B2
(45) Date of Patent: Apr. 11, 2017

(54) STUD INSTALLATION AND REMOVAL TOOL AND METHOD OF USE

(71) Applicant: William R. Hendrix, II, Kingwood, TX (US)

(72) Inventor: William R. Hendrix, II, Kingwood, TX (US)

( * ) Notice: Subject to any disclaimer, the term of this patent is extended or adjusted under 35 U.S.C. 154(b) by 106 days.

(21) Appl. No.: 14/517,911

(22) Filed: Oct. 19, 2014

(65) Prior Publication Data

US 2016/0107300 A1 Apr. 21, 2016

(51) Int. Cl.

*B25B 27/18* (2006.01)
*B25B 13/18* (2006.01)
*B25B 23/10* (2006.01)

(52) U.S. Cl.

CPC ..... *B25B 13/18* (2013.01); *B25B 23/103* (2013.01); *Y10T 29/49815* (2015.01); *Y10T 29/49822* (2015.01); *Y10T 29/49826* (2015.01); *Y10T 29/49947* (2015.01); *Y10T 29/53417* (2015.01); *Y10T 29/53596* (2015.01)

(58) Field of Classification Search

CPC ... B25B 27/18; B25B 13/18; Y10T 29/53596; Y10T 29/53417; Y10T 29/49947; Y10T 29/49822; Y10T 29/49826; Y10T 29/49815

See application file for complete search history.

(56) References Cited

U.S. PATENT DOCUMENTS 2,027,534 A * 1/1936 Ingersoll ..... B25B 13/5066 81/128
4,856,386 A * 8/1989 Rodriguez ..... B25B 13/44 81/53.2
5,251,515 A * 10/1993 Merrick ..... B25B 13/44 279/71

* cited by examiner

*Primary Examiner* — John C Hong

(57) ABSTRACT

An inventive stud removal and installation tool and method of use is disclosed. The inventive tool incorporates a body configured to hold a cage, cam sleeve and jaws. The cam sleeve is capable of being oriented to accomplish either stud removal or installation. The assembly of the tool is modular such that broken elements can be replaced without the need to replace the entirety of the tool.

10 Claims, 5 Drawing Sheets

STUD INSTALLATION AND REMOVAL TOOL AND METHOD OF USE

FIELD OF THE INVENTION

The present invention relates to a tool for installing and removing nuts, bolts and/or studs from a work piece. The invention may be used with nuts, bolts and/or studs of various sizes. The present invention further encompasses a lightweight tool with modular and interchange parts.

BACKGROUND OF THE INVENTION

Studs, threaded bolts or pins are commonly used in industrial applications to fasten equipment together or to fasten objects to some type of foundation. Over time, these studs can become frozen through the process of varying temperatures or exposure to elements. Threaded bolts can become frozen and have the heads twisted off in the removal process, leaving the user with a stud still frozen in place. Historically in all facets of industry extracting studs, bolts and pins has been a major time-consuming and financially-draining experience for maintenance managers around the world.

Oftentimes mechanics needing stud removal services will simply use vice grips or channel locks or the closest tool. One makeshift method commonly used is to "double nut" a stud by threading two nuts onto the stud to be removed, and tightening each nut against the other in opposite directions until they abut and fixedly lock onto the stud. The assembled double nut and stud combination is then removed from the required mechanical device using the double nuts as a "head" for a conventional wrench or socket tool. After the stud is removed, the nuts must be loosened by rotating each in opposite directions and then backed off from the removed stud. This cumbersome and time consuming method is eliminated by use of stud removal tools. A common problem resulting from the aforementioned methods, however, is that the studs will be removed with some damage to the housing, the studs, or both in most cases.

Common hand tools adapted for the purpose include pipe wrenches which employ opposing toothed jaws to bite into the stud when angularly displacing an elongated, radially extending handle to apply angular force to the stud. Other hand tools, chucks or grapples employ different numbers of such jaws, three being the most common, radially forced against the stud using cams, as illustrated by U.S. Pat. No. 3,371,562. A complication of stud removal using such tools is side loading, or the mechanical binding of threaded surfaces against each other. When side loading occurs, heat builds up due to friction between the threaded surfaces, creating a gall which is carried through the housing, tearing out the threads and impeding stud removal.

An alternative is the use of a stud removal tool. However, in the past many stud removal tools were complex, either requiring many individual pieces, or were of a design which required a considerable amount of effort and physical manipulation in removing the headless bolt from the associated mechanical device. Furthermore, traditional stud removal tools are heavy and, thus, cumbersome to use. Additionally, many of these tools were very expensive to manufacture because of the large number and intricacy of the individual components. Furthermore, many of the stud removal tools were designed in such a way that they were prone to breakage and rendered useless upon the failure of any single component.

For example, impact wrenches employing pneumatic pressure produce impulsed angular force to overcome frictional resistance to rotation of the stud. Sockets for use with impact wrenches commonly rely upon differential rotation between the socket and a vehicle bearing gripping jaws and carried within an axially aligned cavity in the socket. Cams on the cavity walls mate with outer curved surfaces of the jaws as the socket rotates to bias the jaws radially inward and into frictional contact with the outer perimeter of the stud. Teeth borne on the inner surface of the jaws bite into the stud to enhance the gripping effect of the frictional contact.

One type of device accomplishes removal by cutting the stud out of the fixture using a blow torch. However, this method of stud removal results in damage to the stud and the fixture. One solution is to use devices that either drill the stud, or cut into the stud, so that torque can be applied to the nut for removal. However, these devices also result in further stripping of the threads of the stud, impeding removal from the fixture.

Another type of device accomplishes fastener removal by inserting an electrode into the broken stud and using a series of intermittent electrical arcs to disintegrate the stud, leaving a stud casing which is then removed manually. Finally the threads of the fixture are cleaned. However, this method of removal results in damage to the stud, is time consuming, involves multiple steps for stud removal, and may result in damage to the fixture.

Other devices using an air impact tool for the removal of large studs exist. Such devices may require a cartridge having many small parts that is used to apply torque to the damaged stud. These multiple small parts of the cartridge, such as multiple helical springs, studs and screws holding gripping jaws together, are prone to breakage when the rotative force of an air impact tool is applied.

Another prior art stud removal tool consists of a housing having a cylindrical bore with finger splits on one end of the housing, and the other end of the housing connecting to an air impact tool. However, the finger splits of the housing cannot fit over multiple stud sizes, so that the tool is limited in usage. A further complication of the cartridges and associated parts is the use of a retaining ring or clip. The retaining ring or clip is prone to breakage, resulting in a damaged and useless tool.

Yet another complication is "chattering." where the tool does not perfectly conform to the size of the fastener. When rotative force is applied using an air impact tool, the removing tool "chatters" over the damaged corners of the fastener, further stripping the fastener or damaging the tool interface with the fastener, and causing 'radii' to form on the end of the tool.

The use of a set of tools having a multiplicity of sizes to conform to different stud sizes exists which proposes to solve the problem of imperfect conformance between removal tool and stud size. However, regardless of the size, the prior art nonetheless results in chattering from an imperfect size conformance; thus, stripping of the thread occurs.

Further, the use of a set of tools having a multiplicity of sizes to conform to stud size presents another complication. If there exists a multiplicity of removal tool sizes in a set, the loss of one of the tools results in a useless tool set.

Furthermore, the insertion of studs is often a difficult, tedious and very expensive task. One makeshift method commonly used is to "double nut" a stud by threading two nuts onto the stud to be inserted, and tightening each nut against the other in opposite directions until they abut and fixedly lock onto the stud. The assembled double nut and stud combination then is inserted into the required mechanical device using the double nuts as a means for driving the assembled combination. After the stud is mounted, the nuts must be loosened by rotating each in opposite directions and then backed off from the mounted stud. This cumbersome and time consuming method is eliminated by forms of stud insertion tools.

However, in the past many stud driving and insertion tools were complex, either requiring many individual pieces, or were of a design which required considerable amount of effort and physical manipulation in mounting the headless bolt or stud into the associated mechanical device. Many of these tools were very expensive to manufacture because of the large number and intricacy of the individual components.

SUMMARY OF THE INVENTION

A stud removal and installation tool comprising of a tool body, a cam sleeve, a cage, jaws and retaining rings is disclosed. In the preferred embodiment, the cam sleeve is inserted into the tool body. The cam sleeve can—based on whether the desired function is removal or installation—be inverted. In the preferred embodiment, the cam sleeve is color coded to indicate the setting of removal or installation. The jaw is inserted into the cage with the leading edge pointing in the direction of desired tool rotation. The cage has a retaining ring machined into the center that acts as a guide for the jaws and prevents the jaws from being displaced. The jaws have a groove into which the retaining ring fits so that the jaws are not bound by the cage. The jaw and cage assembly are inserted into the cam sleeve with anti-seize lubricant. C. A steel retaining ring is clipped into the top of the tool body to hold the cage and jaw assembly into place in the tool body.

The tool body can be manufactured in various lengths and with various drive sizes for the impact wrench that supplies the power to the tool. Furthermore, the tool body can be manufactured from a variety of materials/metals. The two most common materials used are aluminum and steel. The tool body is machined to accept the cam sleeve and is meant to be totally interchangeable with a variety of different sized cam sleeves.

The cam sleeve is machined to fit into the tool body like the teeth or cogs of a gear. Each cam sleeve can be easily removed and reinserted by aligning the teeth together. This gear-like fitting allows the cam sleeve to remain solid and act like one piece when inserted into the tool body. The cam sleeve is machined so that the back side of the jaws ride along the surface. As the jaws glide along the surface of the cam sleeve, they tighten down on the stud being removed or installed. The cam sleeve is made from hardened steel because along with the jaws, it is the piece of the tool that requires the most strength. The cam sleeves are designed to be interchangeable so that if damage occurs to the cam sleeve or the tool body, either can be replaced exclusively of the other tool parts. The cam sleeve can also be inverted so that the tool functions in both directions. This allows the tool to be used as a remover or as an installer. Because the cam sleeve can be removed and inverted to accomplish multiple operations, the inventive toot is much more versatile. Furthermore, the same tool can also be used to fit multiple sizes by changing the cage and jaws.

The cage is used to house the jaws. It acts as a guide for the jaws to ride along the surface of the cam sleeve. The cage is machined with a ring in the center of the window. This ring acts as a guide to keep the jaws lined up in the housing of the cage. The jaws have a groove in the center. The ring of the cage fits loosely into those grooves so that the jaws remain in a square position as they ride on the cam sleeve. The cage utilizes a specific sized jaw. The diameter of the cage is specific to the size of the stud to be installed or removed.

The jaws grip the stud using teeth that are machined to fit on the diameter of the stud. The jaws can be made from hardened steel and are heat treated so that they are harder than most studs. The jaws are the only area of the tool that actually come in contact with the studs. Two jaws make up one set. They are placed in the cage 180 degrees apart and they work in unison when the tool is being rotated. The jaws are designed to fit both the major and the minor diameter of the particular sized stud. After the jaws and cage are inserted into the tool, they ride along the surface of the cam sleeve. As they are rotated inward, they begin to squeeze the stud. In order to achieve maximum surface area contact, the teeth of the jaws must make contact with the stud at every possible point in the rotation process. The teeth are designed to slowly engage the stud at the leading edge. Once the jaws have made contact with the stud and the teeth begin to bite into the stud, the diameter of the teeth and the diameter of the stud match exactly. The jaws now fit like a ring around the stud that squeeze tighter and tighter as the tool is rotated. This causes the tool and the stud to become as one because they are connected at every point of the jaws. This connection allows for the impact wrench, which powers the tool, to transfer energy directly to the stud. The hammering effect of the impact wrench is what breaks the mechanical bind between the threads of the stud and the housing in which it is inserted. The jaws are consumable and can be interchanged like the other components of the tool. The jaws are size specific. Each set will only fit one size stud. As mentioned above, the jaws have a leading and a trailing edge. These edges are used to determine the direction of the rotation of the tool. The leading edge is thinner and consequently sits in an open position when placed in the cage and the tool. The trailing edge is thicker and consequently, catches the stud as the tool is rotated. When the cam sleeve is inverted to allow the tool to operate in a different direction, the jaws must also be inverted so that the leading edge is pointing in the direction of the desired rotation.

In operation, the drive end of the preferred inventive tool is attached to a pneumatically, electrically or hydraulically powered wrench and to transfer the maximum amount of energy of that wrench to the stud, which is attached at the other end of the tool. Studs and/or fasteners are used to connect equipment together. Typically a stud is placed into a housing through rotation at which point a piece of equipment is connected to the housing and a nut is used to tighten the two pieces of equipment together.

In the stud removal aspect, the inventive tool grips the stud with a set of internal jaws that slide along an internal cam. This forces the jaws inward when rotated. As the tool rotates, the jaws are forced to squeeze tighter and tighter, thus forcing rotation of the stud and removal or installation depending upon the direction of rotation.

The inventive tool eliminates all side-loading in the removal process. Side loading occurs when lateral pressure is placed on a stud through a pulling motion. Lateral pressure at one end of the stud creates an opposite lateral pressure at the other end of the stud. This creates a mechanical bind between the stud and the housing in which it is inserted. The more exact and centered the rotation of the stud, the greater the chances of removal through rotation.

The inventive tool may also be used to install studs. The inventive tool design allows for removal or installation through the use of an internal cam sleeve, which can be removed from the tool body, inverted and reinserted to operate in the opposite direction.

The use of the tool is generally on studs or fasteners connecting components of industrial equipment such as pumps, compressors, wind turbines, valves, etc. When used as an installer, the tool allows for increased productivity over other methods such as double nutting because the tool simply slides over a stud, grips it, and rotates it into place in the housing. Because the tool transfers 99% of the energy from the impact wrench, it can be used to accurately torque fasteners in place. The inventive tool also helps the operator distinguish between studs that can be removed through rotation and studs that may be galled, which requires a different process for removal.

BRIEF DESCRIPTION OF THE DRAWINGS

Embodiments of the invention will now be described, by way of example, with reference to the accompanying drawings, wherein.

DETAILED DESCRIPTION

Figure 1:
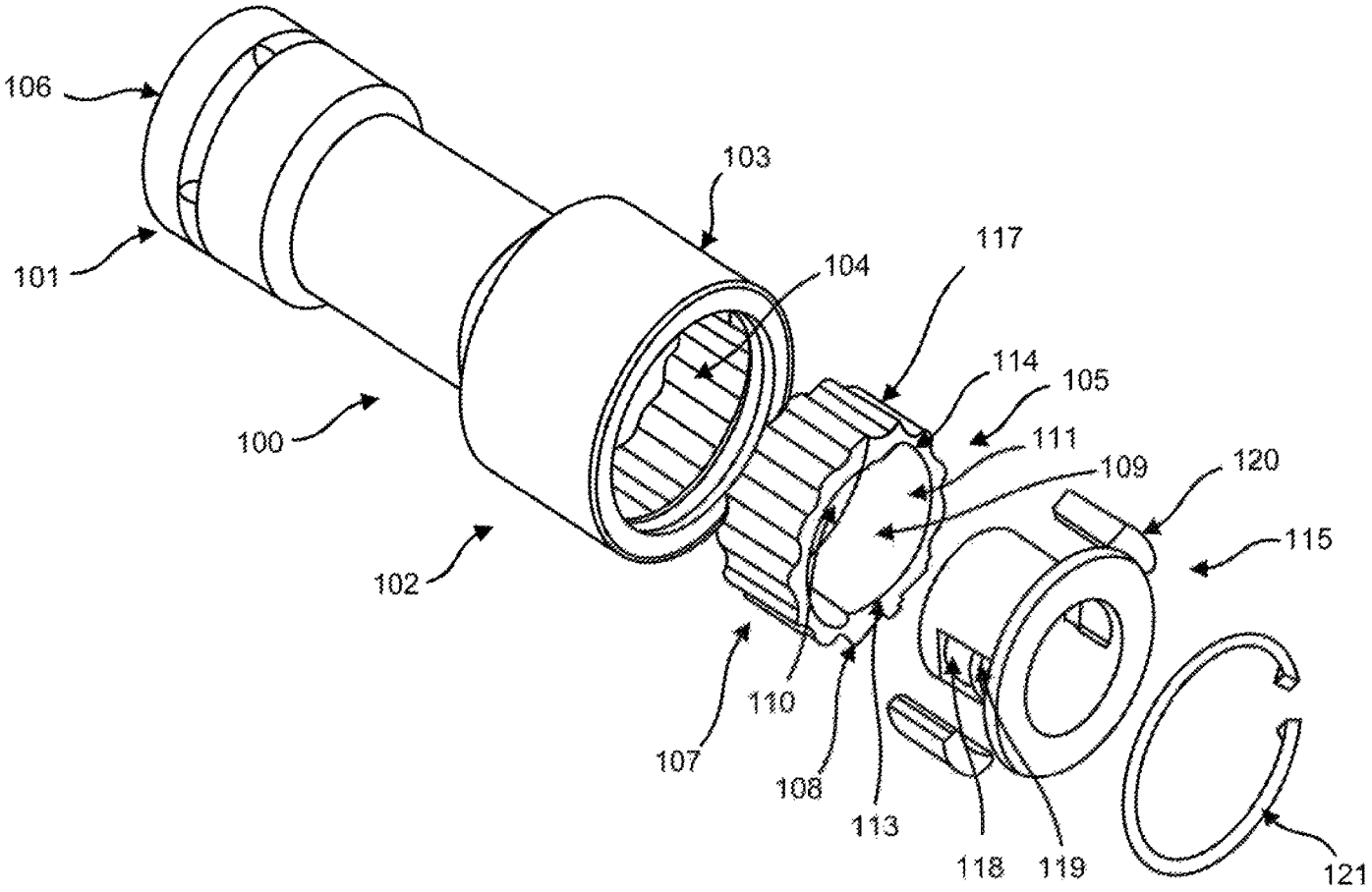
FIG. 1 shows the components of the preferred embodiment of the inventive tool oriented for stud installation.

FIG. 1 of the drawings shows a preferred embodiment of the stud removal and installation tool, having a cylindrical body (100) having a first end (101) and a second end (102) with a hollow cylindrical housing (103) having a front face and side walls. The second end of the hollow interior of cylindrical housing (104) is lined with grooved teeth sized to allow cam sleeve (105) to sit flush inside cylindrical housing (101). The cam sleeve (105) is reversible such that it may be inserted into the body (100) in an orientation for installation of the threaded member or removal of the threaded member. The first end opposite end of the cylindrical body (100) is additionally hollow with a drive recess (106) formed to allow for coupling to an impact tool or driver device with which to apply rotational forces to the stud removal and installation tool. Also shown in FIG. 1 is the cam sleeve (105). The exterior surface of cam sleeve (107) is lined with teeth (108) sized to insert flush into cylindrical housing (101). The interior surface of cam sleeve (109) is formed so that it causes the axial radius of cavity (104) to vary from a minimum where the cam insert is largest (110) at its peak to a maximum where the cam sleeve tapers to its smallest thickness (111). Correspondingly, the thickness of cam sleeve varies from a minimum where cam insert is at its thickest (113) to its maximum where cam insert is at its thinnest (114). Additionally, FIG. 1 depicts the cage assembly (115) which is a cylindrical insert formed so as to sit flush inside the cam sleeve (105), with an outer surface (117) designed to sit flush inside cylindrical housing (103). Furthermore, cage assembly (115) is includes two rectangular cut out windows (118) situated at 180 degrees from one other on the cage assembly (115). Machined into interior surface and extending across the midpoint of the windows (118) is a retaining ring (119) which acts as a guide to jaws (120). The jaws (120) are machined to conform both the exterior of cage assembly (115) and posses teeth which are formed of hardened steel to bite into a stud. Also, shown in figure one is retaining ring (121) which is designed to clip into the end of cylindrical housing (103) to hold cage assembly (115) and cylindrical cam sleeve inside the cylindrical body (103).

Figure 2:
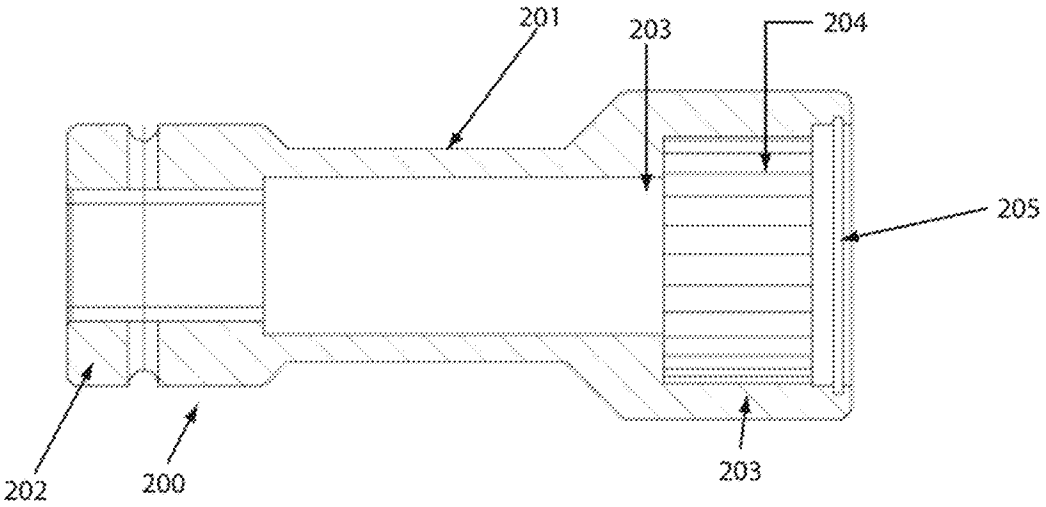
FIG. 2 shows an embodiment of the fully assembled inventive tool.

FIG. 2 depicts the fully assembled stud removal and installation tool with tool body (200) comprising a cylindrical housing (201) having a first end (202) and a second end (203). Cylindrical housing (201) has and interior surface that is machined to form teeth (204) at the second end (203) which interlock and sit flush with the teeth on the exterior surface of a cylindrical cam housing. Also depicted in FIG. 2 is retaining ring (205) which holds cage assembly (not shown) and cylindrical cam housing in place inside cylindrical housing (201).

Figure 3:
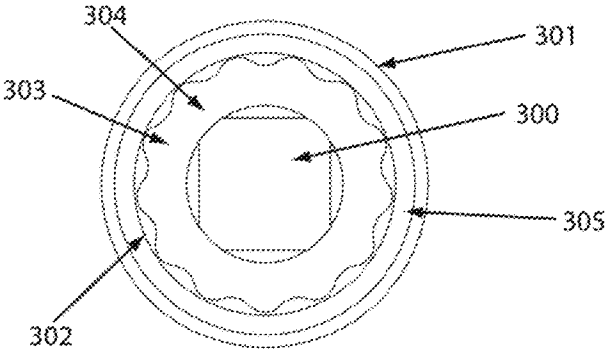
FIG. 3 shows the cage incorporated in the preferred embodiment.

FIG. 3 is a front view of the open end of the fully assembled tool, showing the interior (300) of cylindrical housing (301), with the machined teeth on interior of cylindrical housing (302) interlocked with teeth (303) on the exterior surface of cylindrical cam housing (304), and being held in place by retaining ring (305).

Figure 4:
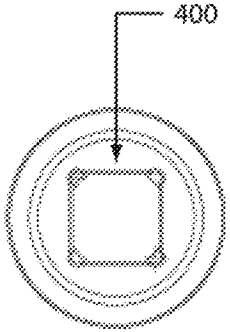
FIG. 4 depicts an embodiment of a first end of the fully assembled inventive tool.

FIG. 4 depicts a rectangular shaped drive recess (400) for coupling the stud remover with a drive, such as an impact tool.

Figure 5:
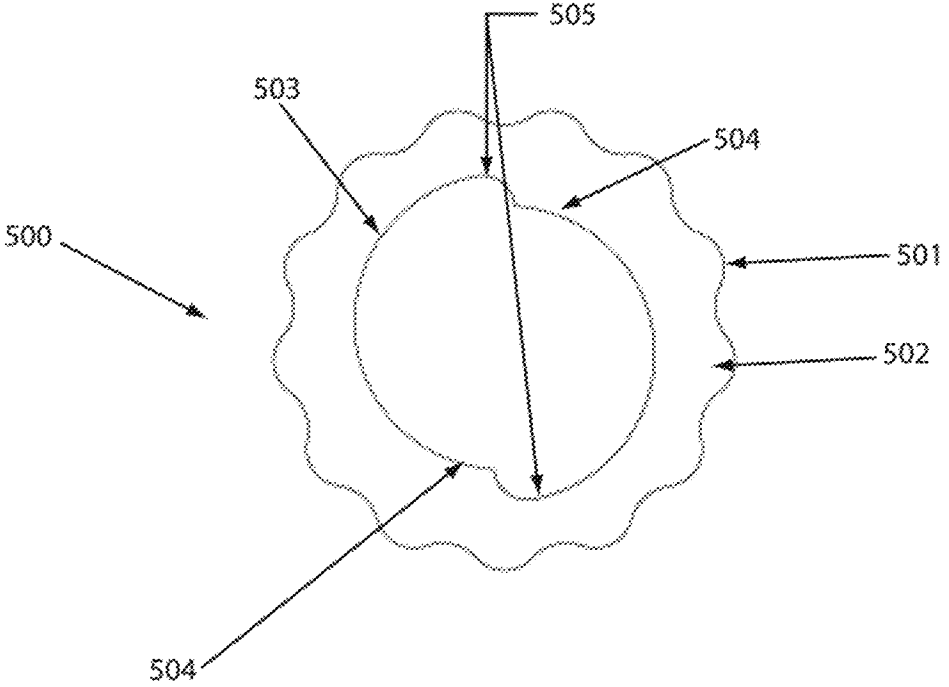
FIG. 5 shows an embodiment of the cam sleeve incorporated in the inventive tool.

FIG. 5 depicts the cylindrical cam sleeve (500). The cylindrical cam sleeve (500) is reversible. The exterior surface of cylindrical cam sleeve (501) is machined to form teeth (502) which are machined to insert flush into a cylindrical housing. The interior surface of cylindrical cam sleeve is formed to that it causes the radius of cavity (503) to vary from a minimum (504) where cylindrical cam sleeve is at its thickest, adjacent to a to maximum (505) where of cylindrical cam sleeve is at its thinnest. The two minimum (504) and two maximum (505) positions on the interior surface of cylindrical cam insert are positioned across from each other at 180 degrees so that the two minimum (504) positions are at 180 degrees and the two maximum (505) positions are at 360 degrees. Cylindrical cam insert sleeve is designed to so that it may be inserted into cylindrical housing in one of two ways, so that minimum (504) positions are either clockwise or counter clock wise to maximum (505) positions, allowing for either installation or removal of studs.

Figure 6:
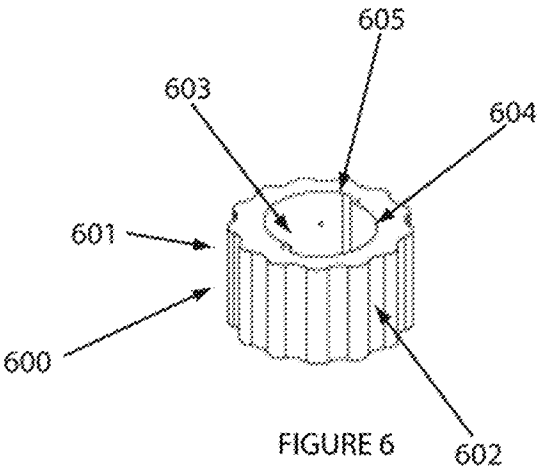
FIG. 6 shows another embodiment of the cam sleeve incorporated in the inventive tool.

FIG. 6 depicts cylindrical cam sleeve (600) from a side angle. The cylindrical cam sleeve (600) is reversible. The cam sleeve has an exterior surface (601) with teeth (602) designed to fit inside and interlock with teeth of the tool body. The cam sleeve has an interior surface (603) such that the width of the cylindrical cam sleeve varies from a maximum (604) to a minimum (605).

Figure 7:
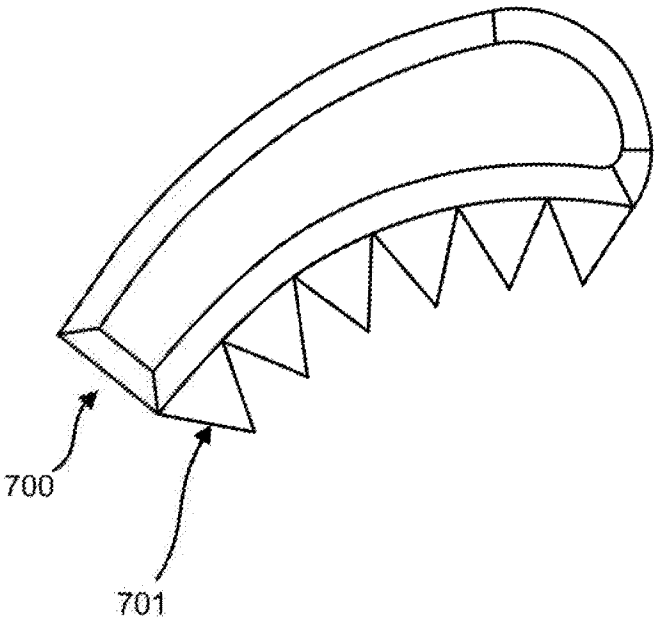
FIG. 7 depicts an embodiment of the jaws incorporated in the inventive tool.

FIG. 7 depicts top side of jaws (700) with teeth (701) which are formed of hardened steel to bite into a stud for installation or removal.

Figure 8:
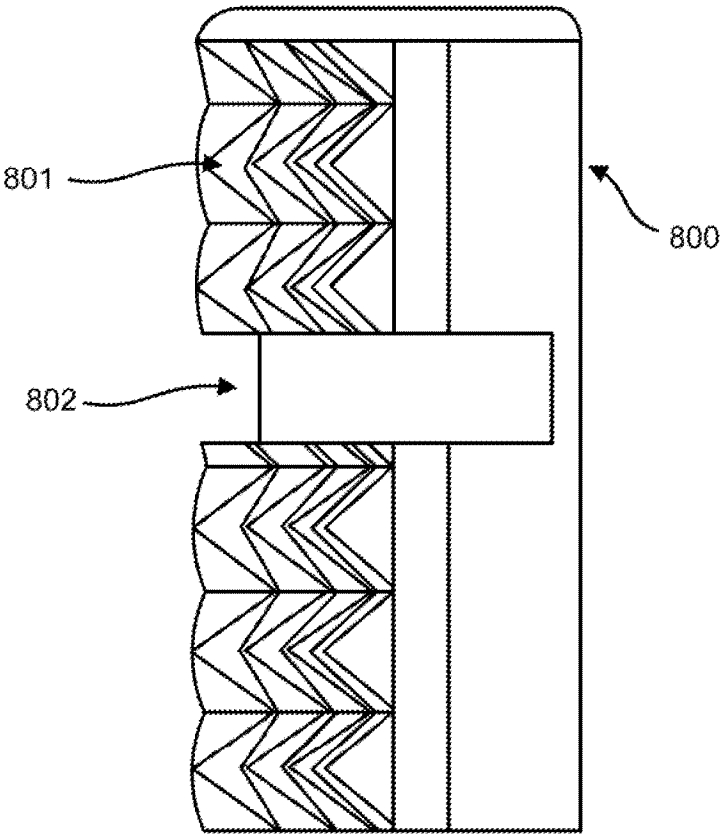
FIG. 8 depicts another embodiment of the jaws.

FIG. 8 is a side view of jaws (800) and teeth (801). Jaws are machined with groove (802) cut into interior of the jaws which fits around retaining rings on exterior of a cage assembly.

Figure 9:
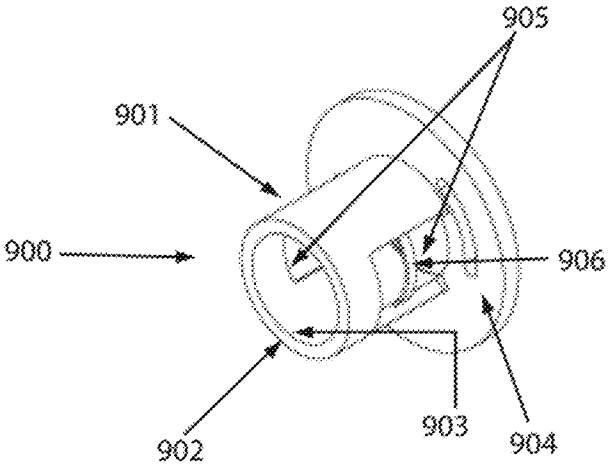
FIG. 9 depicts an embodiment of the cage assembly incorporated in the inventive tool.

FIG. 9 is a view of the insertable side of the cage assembly (900) which inserts into a cylindrical cam shaft. The cage assembly (900) is comprised of a cylindrical body (901) with an outer (902) and inner surface (903) designed to sit flush within the interior of cylindrical cam shaft. Attached to the top surface of cylindrical body (901) and protruding beyond the outer surface (902) is lip (904). Lip (904) sits flush with the side edge against the interior surface of cylindrical housing and the interior edge flush against the exterior surface of cylindrical cam housing. Cut into the cylindrical body (901) are rectangular cutouts (905) which are bisected by retaining rings (906). Retaining rings are machined so that they are flush with inner surface (903) but do not extent to outer surface (902). This allows jaws to sit within cutouts (905)) and move freely along retaining rings (906).

The invention claimed is:

1. A tool for installing or removing a threaded member comprising:

a hollow, cylindrical tool body having a first end and a second end and interior cogs; and a hollow, cylindrical cam sleeve having a first end and a second end and exterior cogs designed to mesh with the cogs of the tool body when the cam sleeve is inserted into the tool body;

wherein the cam sleeve is reversible such that it may be inserted into the tool body in an orientation for installation of the threaded member or removal of the threaded member.

2. The tool of claim 1 further comprising a cage assembly.

3. The tool of claim 1 further comprising jaws.

4. The tool of claim 2 further comprising one or more retaining rings attached to the cage assembly.

5. A method of installing a threaded member comprising:

applying rotational force to a hollow, cylindrical tool body having a first end and a second end and interior cogs; and the tool body having inserted therein a hollow, cylindrical cam sleeve having exterior cogs meshed with the cogs of the tool body;

wherein the cam sleeve is reversible and inserted into the tool body such that it is oriented for installation.

6. The method of claim 5 further comprising a cage assembly inserted into the tool body.

7. The method of claim 6 wherein the cage assembly further comprises one or more retaining rings attached to the cage assembly.

8. A method of removing a threaded member comprising:

applying rotational force to a hollow, cylindrical tool body having a first end and a second end and interior cogs; and the tool body having inserted therein a hollow, cylindrical cam sleeve having exterior cogs meshed with the cogs of the tool body;

wherein the cam sleeve is reversible and inserted into the tool body such that it is oriented for removal.

9. The method of claim 8 further comprising a cage assembly inserted into the tool body.

10. The method of claim 9 wherein the cage assembly further comprises on or more retaining rings attached to the cage assembly.

* * * * *